US005190352A

United States Patent [19]

LeBegue et al.

[11] Patent Number: 5,190,352

[45] Date of Patent: Mar. 2, 1993

[54] MINING MACHINE WITH CASCADING CONVEYOR SYSTEM AND METHOD OF CONVEYING

[75] Inventors: Maurice K. LeBegue; Clarence H. Woodford, II, both of Fairmont, W. Va.

[73] Assignee: Tamrock World Corporation, N.V., Curacao, Netherlands Antilles

[21] Appl. No.: 776,992

[22] Filed: Oct. 16, 1991

[51] Int. Cl.[5] ..... B65G 21/14; E21C 35/20

[52] U.S. Cl. ..... 299/18; 198/587; 198/588; 299/64

[58] Field of Search ..... 299/18, 56, 64; 198/312, 314, 315, 317, 318, 586, 587, 588, 589

[56] References Cited

U.S. PATENT DOCUMENTS

| | | | |
|---|---|---|---|
| 2,588,283 | 3/1952 | Osgood | 198/317 X |
| 2,613,800 | 10/1952 | Merck | 198/861.2 |
| 2,642,981 | 6/1953 | Lindgren | 299/64 X |
| 2,722,409 | 11/1955 | Bergmann | 299/56 |
| 3,268,058 | 8/1966 | Buckeridge et al. | 198/301 |
| 3,557,937 | 1/1971 | Kahre | 198/861.2 |
| 3,993,204 | 11/1976 | Hummel | 414/564 |
| 4,089,403 | 5/1978 | Freed, Jr. et al. | 198/316.1 |
| 4,090,601 | 5/1978 | Freed, Jr. | 198/316.1 |
| 4,281,879 | 8/1981 | LeBegue et al. | 299/64 |
| 4,387,798 | 6/1983 | Jamison et al. | 198/587 |

FOREIGN PATENT DOCUMENTS

| | | | |
|---|---|---|---|
| 2541643 | 3/1977 | Fed. Rep. of Germany | 299/64 |

OTHER PUBLICATIONS

Automated extraction system, National Mine Service Co., Mar. 1979.

*Primary Examiner*—David J. Bagnell
*Attorney, Agent, or Firm*—Stanley J. Price, Jr.

[57] ABSTRACT

A mining machine includes a material dislodging mechanism and a cascading conveyor system extending rearwardly on a mobile frame. The cascading conveyor system includes a fixed, main conveyor and a discharge conveyor underlying the main conveyor and pivotally connected to a stabilizer shoe of the machine for lateral swinging movement 90° on either side of the longitudinal axis of the mining machine. The fixed conveyor and the discharge conveyor are in linear alignment in a first mode of operation. The discharge conveyor is also vertically pivotal on the stabilizer shoe to permit lateral and vertical displacement of the discharge conveyor relative to the main conveyor in a second mode of operation. A dust collecting system includes a longitudinal duct extending beneath the fixed, main conveyor with dual inlets extending above the tracks of the mining machine rearwardly of the dislodging mechanism. The duct bifurcates to exhaust oulets at the rearward end of the machine frame adjacent to the stabilizer shoe. Scrubber fans are positioned in each exhaust outlet with a scrubber screen and demister unit positioned in the duct adjacent the exhaust outlets.

24 Claims, 2 Drawing Sheets

MINING MACHINE WITH CASCADING CONVEYOR SYSTEM AND METHOD OF CONVEYING

BACKGROUND OF THE INVENTION

1. Field of the Invention

This invention relates to a conveying system for a mining machine, and more particularly, to a cascading arrangement of conveyors extending rearwardly on the mining machine frame where a fixed conveyor transfers dislodged material to an end conveyor pivotally mounted on a ground engaging stabilizer of the machine frame for lateral swinging movement to provide increased maneuverability of the mining machine in the mine.

2. Description of the Prior Art

In underground mining operations, it is a well known practice to dislodge solid material from the mine face by a mining machine and convey the material rearwardly on a main conveyor that extends longitudinally on the mining machine. A discharging conveyor section is connected to the main conveyor to pivot relative thereto about a fixed vertical axis. The mined material may be transferred from the discharging conveyor section in one mode to a track haulage system or a belt-type haulage unit or in another mode to a shuttle car which shuttles back and forth from the working face to a fixed discharge station where the mined material is conveyed to the surface.

The pivotal conveyor discharging section is intended to permit the mining machine to maneuver in a crosscut and along a curved path without extended interruption of the mining operation to remove the mined material from the working face. A number of solutions have been proposed to the problem of maintaining substantially continuous rearward movement of the mined material on the mining machine conveyor without interrupting the mining operation. One approach to increasing the maneuverability of the mining machine is the use of articulated conveying sections and cascading arrangements of conveyors with the mining machine, as disclosed in U.S. Pat. No. 4,387,798.

U.S. Pat. No. 2,613,800 discloses an example of an articulated conveyor for a loading machine which gathers the mined material and loads it onto a conveyor mechanism. The conveyor mechanism includes a forward trough section supported by a frame and connected to a delivery section which extends rearwardly through a pivotal connection. The delivery section is swung laterally by piston cylinder assemblies. The forward trough section is movable vertically by a piston cylinder assembly. A centrally disposed endless chain drives flights from the forward section across the pivotal connection to the delivery section.

U.S. Pat. No. 2,722,409 discloses an articulated cascading conveyor which receives mined material from the rearward end of a continuous mining machine. The cascading conveyor transfers the material onto another cascading conveyor and therefrom to successive intermediate cascading sections onto another belt conveyor.

U.S. Pat. No. 3,268,058 discloses a self-propelled sinuous conveyor comprising a series of interconnected discrete units which are self-steerable and guided by an electrical guidance system along a lead wire. The conveyor receives material from a continuous mining machine and conveys it rearwardly along the discrete units by a series of cascading conveyor belts.

U.S. Pat. No. 3,993,204 discloses an extensible conveyor comprising telescoping boom sections connected by piston cylinder assemblies. A chain extends around the periphery of the boom sections in a horizontal plane and is wound at its distal end around a vertically journaled sprocket wheel and a series of aligned idler sprockets at the proximal end thereof. A row of idler sprockets on a slide bar adjacent the proximal end of the conveyor take-up slack in the chain as the conveyor is extended and retracted.

Further examples of articulated conveyor assemblies for mining machinery are disclosed in U.S. Pat. Nos. 3,557,937; 4,089,403; and 4,281,879. Each of these conveyor assemblies includes a fixed section on a frame of a mining machine and a swingable section extending rearwardly therefrom and pivotally connected thereto. A pivot or swivel assembly connects the fixed section with the swingable section.

U.S. Pat. No. 4,089,403 discloses a link with a pivot point for a swingable conveyor section vertically aligned with another pivot point for a fixed conveyor section on a mining machine. The pivot points also have arcuate end sections with intermeshing gears such that a piston cylinder assembly rotating the link relative to the frame of the mining machine rotates the swingable section twice the degree of rotation of the link. With this arrangement, the swingable section is capable of pivoting or swinging laterally through an expanded arc.

U.S. Pat. No. 4,090,601 discloses a conveyor with a fixed section on the frame of a mining machine and a laterally swingable section pivotally extending therefrom. A take-up cylinder operates at a pressure proportional to the fluid pressure supply to the drive side of the conveyor drive motor to take-up slack in the endless chain of the conveyor as it swings laterally around the pivot connection relative to the mining machine frame. The drive to the conveyor is transmitted through the discharge end thereof, which is mounted in the frame of the conveyor for longitudinal movement by the take-up cylinder to adjust tension on the conveyor and eliminate slack in the conveyor when pivoted laterally.

There is need for conveying apparatus on a mining machine that facilitates maneuvering the mining machine as it dislodges material from the mine face so that the mined material is substantially continuously transported from the mine face without encountering delays due to the inability to maintain a continuous conveying surface. While it is known to utilize cascading-type conveyor units for transporting material rearwardly of a mining machine and mining machines having laterally swingable sections pivotally connected to fixed sections, the prior art systems provide a limited range of pivotal movement that restricts the maneuverability of the mining machine or require a multiplicity of connected, articulated conveying sections to provide a curved conveying path.

SUMMARY OF THE INVENTION

In accordance with the present invention there is provided a cascading conveyor system on a mining machine that includes a mining machine mobile frame having a front end portion and a rearward end portion. Means is provided for dislodging mined material and is positioned at the frame front end portion. Stabilizer means pivotally connected to frame rearward end portion moves into engagement with the mine floor to stabilize the mining machine frame. A discharge conveyor is positioned rearwardly of the main conveyor. The discharge conveyor has a receiving end portion and a discharging end portion. The receiving end portion is positioned in underlying relation with the main conveyor discharging end portion for transfer of mined material from the main conveyor to the discharge conveyor. Pivot means is provided for mounting the discharge conveyor receiving end portion on the stabilizer means for pivotal movement of the discharge conveyor laterally of the main conveyor.

Further in accordance with the present invention there is provided a conveyor system for transporting mined material in a mine that includes a mobile conveyor frame. A first conveyor is supported by the conveyor frame to extend longitudinally from adjacent to a mine face. The first conveyor has a receiving end portion for receiving material dislodged from the mine face and a discharging end portion for discharging the mined material therefrom. Ground engaging means is connected to the conveyor frame for supporting the first conveyor discharging end portion at a preselected elevation above the mine floor. A second conveyor extends rearwardly of the first conveyor. A second conveyor has receiving end portion and a discharging end portion. The second conveyor receiving end portion is positioned on the ground engaging means in underlying relation with the first conveyor discharging end portion. Means is provided for connecting the second conveyor receiving end portion to the ground engaging means for lateral swinging movement about a longitudinal axis of the first conveyor.

Additionally, the present invention is directed to a method for conveying dislodged material from a mined face comprising the steps of dislodging material from the mine face by a mining machine. A conveyor extends longitudinally on a frame of the mining machine. The dislodged material is transported on the conveyor rearwardly of the mine face. The mining machine frame is stabilized by ground engaging means connected to the rear of the machine frame as material is dislodged from the mine face and transported on the conveyor. A discharge conveyor is connected to the ground engaging means in underlying relation with the mining machine conveyor to receive dislodged material therefrom. The discharge conveyor is supported on the ground engaging means for lateral swinging movement of the discharge conveyor relative to the mining machine conveyor for diverting the direction the dislodged material is transported from the mine face to the end of the discharge conveyor.

The present invention is also directed to a ventilation system for a mining machine that includes a mining machine body portion and traction means for propelling the body portion. Cutter means is provided for dislodging mined material. The cutter means is connected to the body portion and extends forwardly therefrom. A conveyor support frame extends longitudinally on the body portion. A main conveyor is longitudinally positioned on the conveyor support frame. The main conveyor has a receiving end portion positioned adjacent to the cutter means and a discharging end portion positioned rearwardly on the body portion. Stabilizing means is pivotally connected to the body portion and extends rearwardly from beneath the main conveyor discharging end portion. An end conveyor has a receiving end portion positioned on the stabilizing means underlying the main conveyor discharging end portion to receive dislodged material conveyed rearwardly on the body portion by the main conveyor. The end conveyor has a discharging end portion. Means is provided for pivotally connecting the end conveyor receiving end portion to the stabilizing means to permit the end conveyor discharging end portion to swing laterally through an arcuate path for discharge of the dislodged material at a preselected direction from the main conveyor. A duct assembly is positioned longitudinally on the mining machine body portion. The duct assembly has an intake end positioned adjacent to the main conveyor receiving end portion and an exhaust end positioned adjacent to the connection of the end conveyor receiving end portion to the stabilizing means. The duct assembly extends from the intake end rearwardly above the traction means to a position beneath the main conveyor and extends beneath the main conveyor to the exhaust end and projects outwardly from beneath the main conveyor adjacent to the stabilizing means. A scrubber unit is positioned in the duct assembly at the exhaust end.

Accordingly, the principal object of the present invention is to provide a conveying system for a mining machine that transports mined material from the mine face rearwardly on a conveying surface and permits increased maneuverability of the mining machine while maintaining continuous rearward movement of the material on the conveyor.

Another object of the present invention is to provide a mining machine having a cascading arrangement of conveyors that includes a fixed conveyor that extends longitudinally on the machine frame rearwardly of a material dislodging device to a position overlying the receiving end of a discharge conveyor that is pivotal on the machine frame independently of the fixed conveyor to swing through an arc of substantially 180° relative to the longitudinal axis of the fixed conveyor.

A further object of the present invention is to provide a cascading conveyor system for a continuous mining machine where a main conveyor extends rearwardly from a cutter drum on the mining machine to a position overlying a ground engaging stabilizer that stabilizes the machine frame during the mining operation and a discharge conveyor is mounted on the stabilizer in underlying relation with the main conveyor for both lateral swinging movement and vertical movement to enable the continuous miner to maneuver in the mine while mined material is substantially continuously conveyed from the main conveyor to the discharge conveyor and therefrom to a main haulage system that transports the material out of the mine.

An additional object of the present invention is to provide a mining machine having a conveyor system that facilitates substantially continuous conveyance of dislodged material as the mining machine maneuvers during the mining operation by transporting the mined material on a main conveyor having a fixed length to an extensible conveyor positioned in underlying relation with the main conveyor for lateral swinging movement and vertical movement to a preselected height, permitting the mining machine to advance with the extensible conveyor which is maintained positioned to discharge the mined material onto a main haulage unit.

An additional object of the present invention is to provide a continuous mining machine having a conveyor that includes a discharge end that is pivotal through an arc of substantially 180° without the requirement for hydraulic or pneumatic take-up devices required to maintain uniform tension in the conveyor chain to prevent slack from developing in the chain when the conveyor is swung laterally on the mining machine.

Another object of the present invention is to provide a cascading conveyor system for a mining machine in which a receiving conveyor is fixed in overlying relation with a discharge conveyor that is independently movable of the receiving conveyor about vertical and horizontal pivotal axes to increase the lateral swing of the discharge conveyor relative to the receiving conveyor and adjust the height at which material is discharged from the discharge conveyor.

Another object of the present invention is to provide a dust collecting system on a mining machine that includes a cascading arrangement of conveyors where a ventilation duct assembly extends from an elevated position at an intake end rearwardly of a cutter device beneath a first section of the conveyor to an exhaust end that projects outwardly from beneath the conveyor adjacent to the cascading connection of conveyors.

These and other objects of the present invention will be more completely disclosed and described in the following specification, the accompanying drawings and the appended claims.

DESCRIPTION OF THE PREFERRED EMBODIMENTS

Figure 1:
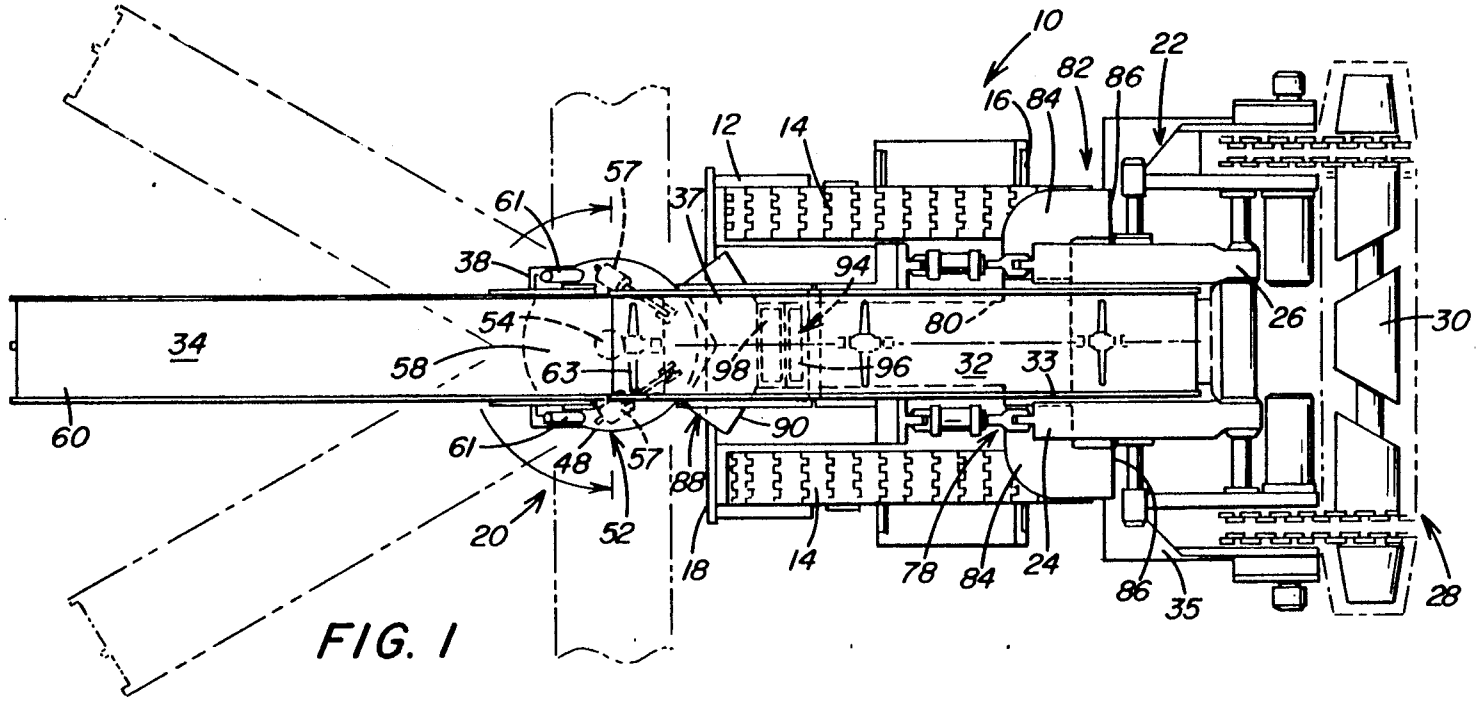
FIG. 1 is a top plan view of a mobile mining machine, illustrating a cascading conveyor system that includes a fixed conveyor section extending rearwardly from a material dislodging device to a discharge conveyor section mounted on a stabilizer for lateral swinging movement, as indicated in phantom.
Figure 2:
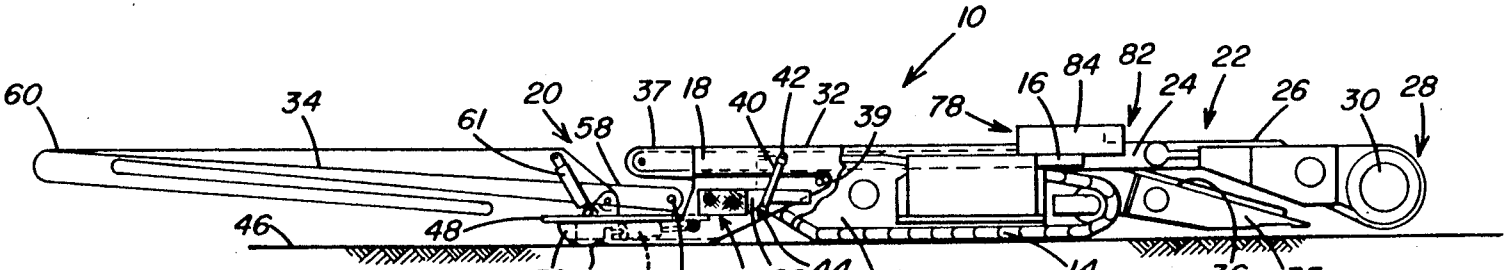
FIG. 2 is a view in side elevation of the mining machine shown in FIG. 1, illustrating the cascading arrangement of the fixed conveyor relative to the laterally movable discharge conveyor which is extensible in length and vertically pivotal.

Referring to the drawings, and particularly to FIGS. 1 and 2, there is illustrated a continuous mining machine generally designated by the numeral 10 for use in an underground mine to dislodge material from a mine face. Continuous mining machine 10 includes a mobile frame assembly 12 and a pair of ground engaging traction devices 14 positioned on each side of mobile frame assembly 12 for propelling mining machine 10 within a mine along the floor thereof.

Continuous mining machine 10 is capable of being operated from a remote control operating station (not shown) in a manner similar to other such machines to dislodge material from the mine face and transport it rearwardly from a front end portion 16 of the mobile frame 12 to a rear end portion 18 of continuous mining machine 10. Accordingly, mining machine 10 includes a cascading-type conveyor assembly generally designated by the numeral 20. Operating controls and sources of power (not shown) are provided on the mining machine 10 for operating the ground engaging traction devices 14, and other power operated equipment on the mining machine 10.

Mining machine 10 also includes a boom assembly generally designated by the numeral 22 having a first end section 24 secured to the front end 16 of mobile frame assembly 12. Boom assembly 22 also includes a second end section 26. As seen in FIGS. 1 and 2, a material dislodging mechanism generally designated at 28 is connected to boom assembly second end section 26. Preferably, the material dislodging mechanism 28 is a rotating cutter drum 30 which is well known in the art. It should be understood, however, that any other desired dislodging mechanism known in the art may also be utilized with the present invention.

The cascading conveyor assembly 20 includes a first or main endless conveyor section 32 and a second or discharge endless conveyor section 34. The first conveyor section 32 extends longitudinally in a trough 33, shown in FIG. 1, that extends from a gathering device 35 positioned beneath the cutter drum 30 rearwardly on the mining machine frame 12. With this arrangement, the gathering device 35 gathers the material dislodged from the mine face by the cutter drum 30 and feeds the dislodged material onto a receiving end portion 36 of the first conveyor section 32. The first conveyor section 32 includes an endless conveyor driven to transport the dislodged material rearwardly from the mine face. The main conveyor section 32 conveys the mined material on the machine frame 12 to a conveyor discharging end portion 37. The conveyor receiving end portion 36 is vertically pivotal on the machine frame 12 and the conveyor discharging end portion 37 is also supported on the machine frame 12 to move up and down.

Second or discharge conveyor section 34 is positioned in underlying, receiving relation with the first conveyor section 32. The discharge conveyor section 34 is not connected to the main conveyor section 32. However, the discharge conveyor section 34 is laterally pivotal with respect to the longitudinal axis of the first conveyor section 32. The range of angular movement of the discharge conveyor section 34 is schematically, illustrated in phantom in FIG. 1. Preferably, the discharge conveyor section 34 is pivotal through a 90° arc on opposite sides of the longitudinal axis of the main conveyor section 32 for a total range of angular movement of substantially 180°.

As illustrated in FIG. 2, a stabilizer shoe 38 is connected by pivot mechanism 39 to the frame rear end portion 18. A pair of piston cylinder assemblies 40 are each connected at one end to a pivot connection 42 on the frame rear end portion 18 and at the opposite end to the stabilizer shoe 38 at a pivot connection 44. Each piston cylinder assembly 40 is hydraulically extensible and retractable to extend the stabilizer shoe 38 into and out of ground engaging contact with mine floor 46. As shown in FIG. 2, the stabilizer 38 is pivoted into contact with the mine floor 46, for example, when the mining machine frame 10 sumps the material dislodging device 28 into the mine face to dislodge mine material. When it is desired to advance or move the entire mining machine 10 the piston cylinder assemblies 40 are retracted in one mode to extend to permit the stabilizer shoe 38 to slide or "float" on the mine floor 46. In a second mode of operation, the assemblies 40 are retracted to the extent that the shoe 38 is pivoted about pivot mechanism 39 to raise or lift the stabilizer shoe 38 to a position removed from contact with the mine floor 36.

Stabilizer shoe 38 has an upper surface and a ground engaging surface 50. The discharge conveyor section 34 is pivotally connected through a turntable-type bearing assembly generally designated by the numeral 52 in FIG. 1 to stabilizer shoe 38. The bearing assembly 52 includes a plate 48 rotatable about a pivot pin 54, schematically illustrated in FIGS. 1 and 2. The plate 48 rotatably supports the frame of the discharge conveyor section 34 on the stabilizer shoe 38. With this arrangement, the discharge conveyor section 34 is laterally movable 90° on either side of a longitudinal axis 56 of the mining machine about pivot pin 54 by operation of piston cylinder assemblies 57. The piston cylinder assemblies 57 are conventional in construction and operation. One end of each assembly 57 is pivotally connected to the stabilizer shoe 38, and the opposite, extensible end is pivotally connected to the discharge conveyor section 34. By retracting one assembly 57 and extending the other assembly 57, the conveyor 34 is swung laterally as desired. In another embodiment, the rotatable plate 48 is connected to the stabilizer shoe 38 through a pinion and ring gear assembly (not shown) whereby the conveyor 34 is also swung laterally through a total angle of substantially 180°.

The discharge conveyor section 34 has a receiving end portion 58 positioned in underlying relation with the main conveyor discharging end portion 37 and a discharging end portion 60. Preferably, the discharge conveyor section 34 is extensible in length, as will be described later in greater detail. The discharge conveyor receiving end portion 58 is also supported by the turntable bearing assembly 52 for vertical pivotal movement about a horizontal pivot connection 62 shown in FIG. 2, in order to adjust the elevation of the conveyor discharging end portion 60.

Vertical pivotal movement of the discharge conveyor 34 is accomplished by actuation of piston cylinder assemblies 61 mounted on the plate 48, as shown in FIG. 1. Each assembly 61 is pivotally connected at one end to the plate 48 of bearing assembly 52 on stabilizer shoe 38 and at an opposite end to the discharge conveyor section 34. Upon actuation of assemblies 61, the conveyor discharging end portion 60 is either raised or lowered about pivot connection 62. The assemblies 61 also pivot with the conveyor section 34 on the bearing assembly 52 when the conveyor section 34 is swung laterally.

Figures 3, 4, 5, 6, 7:
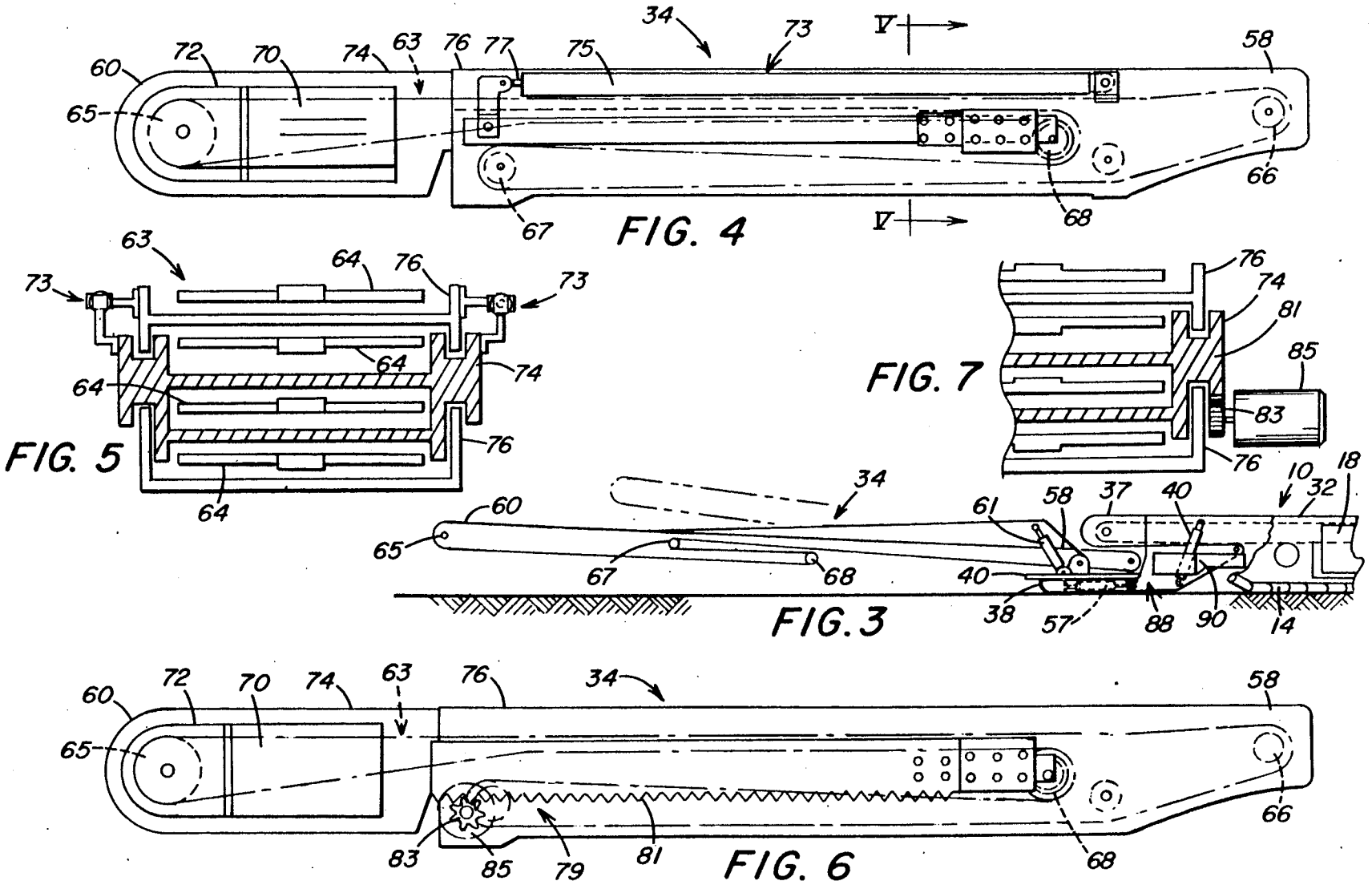
FIG. 3 is a fragmentary schematic view in side elevation of the mining machine with the cascading conveyor system, illustrating the pivotal discharge conveyor in an extended position and elevated as indicated in phantom.
FIG. 4 is an enlarged schematic, elevational view of the extensible discharge conveyor that is pivotally mounted on the stabilizer of the mining machine frame, as shown in FIGS. 1 and 2.
FIG. 5 is a schematic sectional view of the discharge conveyor taken along line V—V in FIG. 4, illustrating the relatively movable frame members that allow for extension of the discharge conveyor.
FIG. 6 is a view similar to FIG. 4, illustrating another embodiment of the extensible discharge conveyor.
FIG. 7 is a fragmentary sectional view of the discharge conveyor taken along line VII—VII of FIG. 6.

The discharge conveyor section 34, as shown in FIGS. 4 and 5, is an endless extensible chain conveyor generally designated by the numeral 63 that includes transversely connected flights 64. The chain conveyor 34 is reeved about a drive roller 65 at discharging end portion 60, an idler roller 66 at the receiving end portion 58, and intermedite idler rollers 67 and 68. The drive roller 65 is drivingly connected to a motor 70 carried in a gearcase 72. The conveyor section 34 includes frame portions 74 and 76. The gearcase 72 is mounted on frame portion 74. The frame portion 74 is slidable relative to frame portion 76. The frame portion 76 is laterally pivotal about pin 54 and vertically pivotal about horizontal pivot connection 62. The frame portion 74 is slidably movable on the fixed frame portion 76, as further shown in FIG. 5. The idler pulley 68 is mounted on the slidable frame portion 74. The idler pulleys 66 and 67 are mounted on the fixed frame portion 76.

Conventional piston cylinder assemblies 73 are connected to and extend between frame portions 74 and 76 and are operable to advance and retract the frame portion 74 relative to the frame portion 76. Assemblies 73 each includes a cylinder portion 75 connected to the fixed frame portion 76 and an extensible piston portion 77 connected to the slidable frame portion 74. Upon actuation of the piston cylinder assemblies 73, the piston portions 77 extend to extend the frame portion 74 outwardly to increase the length of the discharge conveyor section 34. The idler roller 68 moves with the frame portion 74; while, the idler rollers 66 and 67 remain stationary with the frame portion 76. Therefore, as shown in FIG. 2 to extend the conveyor section 34 the frame portion 74 moves on the frame portion 76, and the distance between the idler rollers 67 and 68 decreases. In other words, the rollers 67 and 68 move closer together from the fully retracted position as shown in FIG. 4. The idler roller 68 advances toward the idler roller 67. This is shown in FIG. 2 where the conveyor 34 is fully retracted and in FIG. 3 where the conveyor 34 is fully extended. Thus, even though the length of the conveying surface increases between end portions 58 and 60, the length of the flexible conveyor chain 63 reeved about the rollers 65, 66, 67, and 68 remains the same.

Referring to FIGS. 6 and 7, there is shown another embodiment for generating siding movement of the conveyor frame portion 74 relative to the conveyor frame portion 76 in order to extend and retract the pivotal discharge conveyor section 34. This is accomplished by a rack and pinion assembly generally designated by the numeral 79 where a gear rack 81 is carried by the slidable frame portion 74 and is engaged by a pinion gear 83. The pinion gear 83 is rotatably mounted on the fixed frame portion 76 and is drivingly connected to a pinion drive 85. Actuation of the pinion drive 85 rotates the pinion gear 83 in a preselected direction to advance the gear rack 81 on the gear 83. Rotation of the gear 83 in one direction advances the frame portion 74 on the frame portion 76 to extend the discharge conveyor 34. Rotation of the gear 83 in an opposite direction retracts the frame portion 74 on the frame portion 76 to withdraw the discharge conveyor 34 from an extended position.

In operation, the material dislodging mechanism 28 dislodges material from the mine face. The mined material is directed onto the main conveyor receiving end portion 36 by the gathering device 35 and is transported rearwardly on the mining machine frame 12 to the discharging end portion 37. From the main conveyor section 32, the mined material is transferred to the receiving end portion 58 of the pivotal discharge conveyor section 34. The mined material cascades downwardly onto the discharge conveyor receiving end portion 58 which is maintained in underlying relation with the main conveyor discharging end portion 37. During this operation, the main conveyor section 32 remains fixed on the machine frame 12 with conveyor end portion 37 positioned over conveyor end portion 58. However, the discharge conveyor section 34 is not connected to the main conveyor section 32 so as to increase the range of laterally swinging movement of the discharge conveyor section 34.

The discharge conveyor section 34 is mounted on the stabilizer shoe 38 which is connected to the machine frame 12. Therefore, because the stabilizer shoe 38 is vertically adjustable relative to the mine floor 46 by operation of the piston cylinder assemblies 40, the vertical height of the second conveyor section 34 can be adjusted and the first conveyor section 32 follows The second conveyor section 34 is also vertically pivotal about the horizontal pivot connection 62 by operation of piston cylinder assemblies 61. Thus, a considerable range of vertical height adjustment for the discharge conveyor section 34 is available. This is particularly desirable for maneuvering the mining machine 10 in low ceiling heights where a cascading conveyor system has not been previously operational. Thus, with the present invention the cascading connection of the discharge conveyor section 34 to the mining machine frame 10 is height adjustable by virtue of mounting the conveyor section 34 on the stabilizer shoe 38. The stabilizer shoe 38 is vertically adjustable between a maximum elevated position removed from contact with the mine floor 46 and a position where it engages the mine floor 46.

Further, by connecting the discharge conveyor section 34 to the stabilizer shoe 38 for lateral swinging movement about the machine frame longitudinal axis 56, a hinged or pivotal connection between the conveyor sections 32 and 34 is eliminated. This avoids the problems heretobefore encountered with take-up devices for controlling tension in mining machine conveyors having articulated conveyor sections.

With the present invention of mounting the discharge conveyor section 34 on the stabilizer shoe 38, linear conveyors are used, and they are pivotal relative to one another. There is no need for an articulated connection requiring tension control and take-up devices. Further, by mounting the discharge conveyor section 34 on the stabilizer shoe 38 underlying the main conveyor section 32, a greater range of lateral pivotal movement than previously available with an articulated mining machine conveyor is now possible Thus, the cascading conveyor assembly 20 of the present invention permits lateral swinging movement of substantially 180°, 90° on either side of the longitudinal axis 56 of the frame 12 of the continuous mining machine 10, and is arranged to pivot vertically around pivot point 62. With this arrangement, the mining machine 10 is particularly adapted to maneuver along a curved path in low seam coal without additional height requirements to accomodate cascading arrangement of conveyors.

The high angle of maneuverability of the discharge conveyor section 34 in combination with a long discharge conveyor provided thereby allows the continuous mining machine 10 to maneuver forming entries while still allowing a receiving conveyor (shuttle car) or main haulage unit (not shown) to receive mined material from the discharge conveyor section 34. A very long overlap of a main haulage unit with the discharge conveyor section 34 is provided. This allows for increased maneuverability of the mining machine 10 with respect to the main haulage unit or any other type of receiving conveyor. This configuration also allows the mining machine to advance further from the last roof support in the entry while operating in so called "deep" cut systems.

The mining machine 10 of the present invention also includes a dust collecting system generally designated by the numeral 78, as illustrated in FIGS. 1 and 2. The dust collecting system 78 includes a duct assembly 80 which extends adjacent and parallel to first conveyor section 32 from the front end portion 16 to the rear end portion 18 of the mining machine frame 12. Dust collecting system 78 also includes an inlet duct portion generally designated by the numeral 82 having a pair of vertical duct sections 84, as shown in FIG. 1 extending upwardly from and in fluid communication with duct assembly 80. A pair of inlets 86 extend laterally and forwardly from and are in fluid communication with vertically extending duct sections 84. Dust entrained from the vicinity of the material dislodging mechanism 28 enters the duct assembly through inlets 86.

The duct sections 84 extend rearwardly from the inlets 86 above the traction devices 14 and diverge downwardly beneath the conveyor trough 33 to longitudinally extending duct assembly 80. The duct assembly 80 extends beneath the main conveyor section 32 to an exhaust duct generally designated by the numeral 88. The exhaust duct 88 bifurcates adjacent to the stabilizer shoe 38 beneath the main conveyor section 32 to form a pair of discharge ducts 90. A scrubber fan assembly (not shown) is located in each discharge duct 90 to induce the flow of air through dust collecting system 78 such that cleaned air from dust collecting system 78 may be discharged on either side of the frame 12 adjacent to the connection of the discharge conveyor section 34 on the stabilizer shoe 38. A scrubber unit generally designated by the numeral 94 is positioned in duct assembly 80 adjacent to the discharge ducts 90. The scrubber unit 94 includes a conventional arrangement of a scrubber screen 96 and a demister 98. The scrubber screen 96 and demister 98 are well known in the art.

With the above-described arrangement of positioning the dust collecting system 78 beneath the main conveyor section 32 and positioning the inlets 86 above the traction devices 14 at the rear of the boom assembly 22 additional headroom for a dust collecting and ventilation system is not required. Consequently, the dust collecting system 78 obviates the problems heretobefore encountered with prior art ventilitation systems that require additional tramming height which is particularly undesirable for mining machines utilized in low seam coal.

According to the provisions of the patent statutes, we have explained the principle, preferred construction and mode of operation of our invention and have illustrated and described what we now consider to represent its best embodiments. However, it should be understood that within the scope of the appended claims, the invention may be practiced otherwise than as specifically illustrated and described.

We claim:

1. A cascading conveyor system on a mining machine comprising, a mining machine mobile frame having a front end portion and a rearward end portion, means for dislodgeing mine material, said means being positioned at said frame front end portion, stabilizer means pivotally connected to said frame rearward end portion for moving said stabilizer means into and out of engagement with the mine floor to stabilize said mining machine frame, a main conveyor positioned on said mobile frame to extend from said front end portion rearwardly of sad means for dislodging to said frame rearward end portion, said main conveyor including a material discharging end portion overlying said stabilizing means, a discharge conveyor positioned rearwardly of said main conveyor, said discharge conveyor having a receiving end portion and a discharging end portion, said discharge conveyor receiving end portion positioned in underlying relation with said main conveyor discharging end portion on said stabilizer means for transfer of mined material from said maine conveyor to said discharge conveyor, and pivot means for mounting said discharge conveyor receiving end portion on said stabilizer means for pivotal movement of said discharge conveyor laterally of said main conveyor.

2. A cascading conveyor system as set forth in claim 1 which includes, means for extending the length of said discharge conveyor to extend the length of the conveying path for transportation of the dislodged material from said main conveyor to said discharge conveyor.

3. A cascading conveyor system as set forth in claim 1 in which, said pivot means includes a vertical pivot connection of said discharge conveyor receiving end portion on said stabilizer means, and means extending between said discharge conveyor receiving end portion and said stabilizer means for initiating lateral swinging movement of said discharge conveyor through an arc of substantially 180°.

4. A cascading conveyor system as set forth in claim 1 which includes, means extending between said mining machine frame and said stabilizer means for raising and lowering said stabilizer means with respect to the mine floor to control the elevation of said discharge conveyor discharging end portion above the mine floor.

5. A cascading conveyor system as set forth in claim 1 which includes, means extending between said stabilizer means and said discharge conveyor for adjusting the elevation of said discharge conveyor discharging end portion above the mine floor.

6. A cascading conveyor system as set forth in claim 1 which includes, means for permitting said stabilizer means to float on the mine floor to position said discharge conveyor receiving end portion underlying said main conveyor discharging end portion at a lowermost position in the range of height adjustment of said discharge conveyor receiving end portion.

7. A cascading conveyor system as set forth in claim 1 which includes, means for raising said stabilizer means on said frame rearward end portion to elevate said discharge conveyor receiving end portion to a preselected height above the mine floor.

8. A cascading conveyor system as set forth in claim 1 in which, said discharge conveyor includes a first frame portion connected to said stabilizer means and a second frame portion, said second frame portion being slidable on said first frame portion to adjust the length of said discharge conveyor between said receiving end portion and said discharging end portion, an endless conveyor, roller means mounted on said first and second frame portions for rotatably supporting said endless conveyor between said receiving and discharging end portions, and said roller means movable toward and away from each other upon extension and retraction of said second frame portion with respect to said first frame portion to increase the length of the conveying path formed by said endless conveyor between said discharge conveyor receiving and discharging end portions.

9. A cascading conveyor system as set forth in claim 1 in which, said stabilizer means includes a ground engaging surface, pivot means for connecting said stabilizer means to said frame rearward end portion for movement about a horizontal pivotal axis to move said ground engaging surface into and out of contact with the mine floor, and a bearing assembly rotatably supported by said stabilizer means for connecting said discharge conveyor receiving end portion to said stabilizer means for lateral pivotal movement of said discharge conveyor about a vertical pivotal axis.

10. A cascading conveyor system as set forth in claim 9 in which, said mining machine frame includes a longitudinal axis, and said discharge conveyor being pivotal about said vertical pivotal axis through an arc of 90° on each side of said longitudinal axis.

11. A cascading conveyor system as set forth in claim 9 which includes, piston cylinder means extending between said frame rearward end portion and said stabilizer means for raising and lowering said ground engaging surface with respect to the mine floor to adjust the elevation of said horizontal and vertical pivot axes above the mine floor.

12. A conveyor system for transporting mined material in a mine comprising, a mobile conveyor frame, a first conveyor supported by said conveyor frame to extend longitudinally from adjacent a mine face, said first conveyor having a receiving end portion for receiving material dislodged from the mine face and a discharging end portion for discharging the mined material therefrom, ground engaging means connected to said conveyor frame for supporting said first conveyor discharging end portion at a preselected elevation above the mine floor, a second conveyor extending rearwardly of said first conveyor, said second conveyor having a receiving end portion and a discharging end portion, said second conveyor receiving end portion positioned on said ground engaging means in underlaying relation with said first conveyor discharging end portion, and means for pivotally connecting said second conveyor receiving end portion to said ground engaging means for lateral swinging movement about a longitudinal axis of said first conveyor.

13. A conveyor system as set forth in claim 12 in which, said first conveyor discharging end portion is fixed in overlying relation with said second conveyor receiving end portion being supported by said ground engaging means, and means for raising and lowering said ground engaging means into and out of contact with the mine floor to adjust the elevation of said second conveyor receiving end portion with respect to the mine floor.

14. A conveyor system as set forth in claim 12 which includes, means for extending the length of said second conveyor to thereby adjust the length of the conveying surface provided by said first and second conveyors, and means for adjusting the elevation of said second conveyor discharging end portion with respect to the mine floor to thereby control the height for discharging mined material from the second conveyor discharging end portion.

15. A conveyor system as set forth in claim 12 which includes, means for connecting said second conveyor receiving end portion to said ground engaging means about a horizontal pivotal axis to pivot said second conveyor to position said discharging end portion thereof at a preselected elevation above the mine floor.

16. A conveyor system as set forth in claim 12 which includes, a bearing assembly positioned on said ground engaging means for rotatably supporting said second conveyor receiving end portion, said bearing assembly including a vertical pivot pin for connecting said second conveyor receiving end portion to said ground engaging means, and means for initiating pivotal movement of said second conveyor about said vertical pivot pin to swing said second conveyor laterally relative to said first conveyor.

17. A method for conveying dislodged material from a mine face comprising the steps of, dislodging material from a mine face by a mining machine, extending a main conveyor longitudinally on a frame of the mining machine, transporting the dislodged material on the main conveyor rearwardly of the mine face, stabilizing the mining machine frame by ground engaging means connected to the rear of the machine frame as material is dislodged from the mine face and transported rearwardly on the main conveyor, connecting a discharge conveyor to the ground engaging means in underlying relation with the main conveyor to receive dislodged material therefrom, and supporting the discharge conveyor on the ground engaging means for lateral swinging movement of the discharge conveyor relative to the main conveyor for diverting the direction the dislodged material is transported from the mine face to the end of the discharge conveyor.

18. A method as set forth in claim 17 which includes, swinging the discharge conveyor on the ground engaging means through an arc of 180° about a longitudinal axis of the main conveyor.

19. A method as set forth in claim 17 which includes, overlapping a discharge end of the discharge conveyor with a haulage unit, and extending the length of the discharge conveyor to maintain the overlapping relation of the discharge conveyor with the haulage unit as the mining machine advances forwardly in dislodging material from the mine face.

20. A method as set forth in claim 17 which includes, maintaining the ground engaging means in contact with the mine floor as the mining machine advances forwardly in dislodging material from the mine face to position the discharge conveyor receiving end portion in a lowermost position.

21. A ventilation system for a mining machine comprising, a mining machine body portion, traction means for propelling said body portion, cutter means for dislodging mine material, said cutter means connected to said body portion and extending forwardly therefrom, a conveyor support frame extending longitudinally on said body portion, a main conveyor longitudinally positioned on said conveyor support frame, said main conveyor having a receiving portion positioned adjacent to said cutter means and a discharging end portion positioned rearwardly on said body portion, stabilizing means pivotally connected to said body portion and extending rearwardly from beneath said main conveyor discharging end portion, an end conveyor having a receiving end portion positioned on said stabilizing means underlying said main conveyor discharging end portion to receive dislodged material conveyed rearwardly on said body portion by said discharge conveyor, said end conveyor having a discharging end portion, means for pivotally connecting said end conveyor receiving end portion to said stabilizing means to permit said end conveyor discharging end portion to swing laterally through an arcuate path for discharge of the dislodged material at a preselected direction from said main conveyor, a duct assembly positioned longitudinally on said mining machine body portion, said duct assembly having an intake end positioned adjacent to said main conveyor receiving end portion and an exhaust end positioned adjacent to the connection of said end conveyor to said stabilizing means, said duct assembly extending from said intake end rearwardly above said traction means to a position beneath said conveyor and extending beneath said discharge conveyor to said exhaust and projecting outwardly from beneath said main conveyor adjacent to said stabilizing means, and a scrubber unit positioned in said duct assembly at said exhaust end.

22. A ventilation system as set forth in claim 21 in which, said exhaust end includes a pair of discharge ducts extending outwardly from beneath said main conveyor on opposite sides thereof, and said discharge ducts being positioned adjacent to the connection of said end conveyor receiving end portion on said stabilizing means.

23. A ventilation system as set forth in claim 21 which includes, means for elevating the connection of said end conveyor to said stabilizing means relative to said duct assembly exhaust end.

24. A ventilation system as set forth in claim 21 which includes, means for extending the length of said end conveyor to maintain said end conveyor overlying a haulage unit while said mining machine advances forwardly in the dislodging operation.

* * * * *